US006789716B1

(12) United States Patent
Davignon et al.

(10) Patent No.: US 6,789,716 B1
(45) Date of Patent: Sep. 14, 2004

(54) INDIVIDUAL PLASTIC FASTENER AND NEEDLE FOR DISPENSING THE SAME

(75) Inventors: Paul A. Davignon, Uxbridge, MA (US); Steven E. Flannery, Wayland, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/054,716

(22) Filed: May 28, 2002

(51) Int. Cl.[7] ..... B25C 1/00
(52) U.S. Cl. ..... 227/67; 227/70; 227/71
(58) Field of Search ..... 227/67, 70, 71, 227/76, 31, 32, 37; 24/704.1, 459

(56) References Cited

U.S. PATENT DOCUMENTS

| | | | | |
|---|---|---|---|---|
| 3,494,004 A | | 2/1970 | Bone | |
| 4,039,078 A | | 8/1977 | Bone | |
| 4,288,017 A | | 9/1981 | Russell | |
| 4,456,123 A | | 6/1984 | Russell | |
| 5,669,543 A | * | 9/1997 | Ueno | 227/67 |
| 5,715,984 A | | 2/1998 | Deschenes | |
| 6,047,823 A | * | 4/2000 | Deschenes et al. | 24/711.1 |
| 6,173,836 B1 | | 1/2001 | Cooper | |

* cited by examiner

*Primary Examiner*—Stephen F. Gerrity
*Assistant Examiner*—Michelle Lopez
(74) *Attorney, Agent, or Firm*—Kriegsman & Kriegsman

(57) ABSTRACT

An individual plastic fastener for coupling together two or more items includes a shortened, cylindrical connector having a first end and a second end, a first disk-shaped cross-member integrally formed onto the first end of the connector and a second disk-shaped cross-member integrally formed onto the second end of the connector. Each of the first and second disk-shaped cross-members include a flat inner surface, a flat outer surface and a rounded side surface. A flat needle is designed for use in dispensing the individual plastic fastener. The needle terminates in a flattened tip and is shaped to define a longitudinally-extending rectangular bore which is dimensioned to receive one of the cross-members of the fastener and a longitudinally-extending slot which is dimensioned to permit the connector to extend therethrough while the cross-member is disposed within the bore.

14 Claims, 3 Drawing Sheets

INDIVIDUAL PLASTIC FASTENER AND NEEDLE FOR DISPENSING THE SAME

BACKGROUND OF THE INVENTION

The present invention relates to an individual plastic fastener and a needle for dispensing the same.

In U.S. Pat. No. 4,039,078 to A. R. Bone, which is incorporated herein by reference, there are disclosed several different types of plastic fasteners, or attachments, which are fabricated as part of continuously connected ladder stock. In each instance, the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping.

U.S. Pat. No. 4,039,078 to A. R. Bone discloses one embodiment of continuously connected ladder stock which, when cut, produces a plurality of individual fastener attachment devices (which are commonly referred to simply as fasteners). Each resulting fastener comprises a pair of end bars, preferably of the same length, which are coupled together by a thin filament. Each end bar of the fastener has an elongated cylindrical shape which is generally circular in lateral cross-section (such an end bar being commonly referred to as a "T-bar" in the art).

The resulting fastener described above is well known in the art and is widely used in commerce to attach labels, price tags or other items to articles of purchase in a manner which minimizes the risk of inadvertent detachment therefrom.

However, it has been found that such plastic fasteners suffer from a drawback in design. Specifically, the elongated cylindrical shape of each end bar of the fastener detracts from the aesthetics of the article of purchase when dispensed therethrough, which is highly undesirable.

The dispensing of individual fasteners from fastener stock is often accomplished with an apparatus commonly referred to as a tagger gun. A tagger gun is a hand held trigger operated device which is constructed to accept fastener stock. A tagger gun usually comprises a plastic housing body with a cylindrical opening into which a hollow needle having a longitudinal slot extending over its length is removably mounted. A clip of fastener stock is inserted into a slot in the housing which extends behind the needle. Actuation of a trigger on the tagger gun causes a plunger, aligned with the cross bar end of the first attachment in the fastener stock, to be displaced forward such that the cross bar end of the first attachment in the stock is forced through the bore in the needle. Some tagger guns are manually operated while other tagger guns are powered by an electric motor or a pneumatic device.

The hollow needle of a tagger gun typically comprises a substantially cylindrical base portion having a front end, a rear end, a side surface, a central bore, a longitudinal slot and a recess on the side surface for accommodating a needle locking shaft. The hollow needle also comprises a stem portion which extends out from the front end of the base portion. The stem portion is a substantially cylindrically shaped needle which includes a sharpened tip, a longitudinal slot in alignment with the longitudinal slot in the base portion, and a central bore in alignment with the central bore in the base portion. A portion of the longitudinal slot proximate to the tip of the stem portion is shaped to define an elongated opening (said portion being commonly referred to as the spoon of the needle) which is greater in size than the cross bar end of the fastener to be dispensed therethrough.

An example of such a needle which can be used as part of a plastic fastener dispensing tool is disclosed in U.S. Pat. No. 5,715,984 to C. L. Deschenes. The needle includes a knife portion on the rear end of the base portion. The knife portion includes a cutting edge, the entire length of the cutting edge being in the shape of a "V"-shaped notch.

Various types of tagger guns have been developed for use in dispensing individual plastic fasteners from a supply of fastener stock. For example, in U.S. Pat. No. 4,456,123 to D. B. Russell, which is incorporated herein by reference, there is disclosed an apparatus for dispensing fasteners which is manufactured and sold by AVERY DENNISON CORPORATION® of Pasadena, Calif. as the SYSTEM 1000® SWIFTACHER® Tool. The apparatus can be used to store, feed and dispense fastener stock of the type which includes a plurality of connected fasteners, each fastener comprising a flexible filament and a transversely disposed end-bar at one end, end-bars of adjacent fasteners being joined end-to-end by severable connectors at a portion of their peripheries. The apparatus comprises a hollow casing and a dispensing needle mounted to the casing, the needle having a longitudinal bore for slidably receiving the end-bar and a slot communicating with the longitudinal bore slidably receiving the filament. The apparatus also comprises means for advancing a fastener from a first position remote from the needle bore to a second position adjacent the rear end of the bore with the end-bar transversely disposed to the longitudinal axis of the bore, means for aligning the end-bar with the bore and means for dispensing the end-bar through the bore.

SUMMARY OF THE INVENTION

It is an object of the present invention to provide a new and improved individual plastic fastener for coupling together two or more items and a needle for dispensing the same.

It is another object of the present invention to provide an individual plastic fastener as described above which is aesthetically pleasing.

It is yet another object of the present invention to provide an individual plastic fastener as described above which can be used in paper stapling applications.

It is still another object of the present invention to provide a needle as described above which creates a limited sized opening in the two or more items when inserted therethrough.

It is yet still another object of the present invention to provide an individual plastic fastener and a needle for dispensing the same as described above which have a limited number of parts, which are inexpensive to manufacture and which are easy to use.

Accordingly, as one feature of the present invention, there is provided a fastener for coupling together two or more items, said fastener comprising a connector having a first end and a second end, a first cross-member formed onto the first end of said connector, said first cross-member comprising a flat inner surface and a flat outer surface, and a second cross-member formed onto the second end of said connector.

As another feature of the present invention, there is provided a needle well-suited for use in dispensing a plastic fastener of the type comprising a connector having a first cross-member at a first end thereof, said needle comprising a flat bottom wall, a pair of spaced apart sidewalls which extend orthogonally up from said flat bottom wall, and a pair of flanges, one flange being formed onto and extending orthogonally inward from the free end of each of said pair of sidewalls.

As another feature of the present invention, there is provided the combination of a fastener and a needle, said fastener comprising a connector having a first cross-member at a first end thereof and a second cross-member at a second end thereof, the first cross-member having a flat inner surface and a flat outer surface, said needle terminating in a tip at a front end thereof and being shaped to define a longitudinally-extending bore and a longitudinally-extending slot, said longitudinally-extending bore being dimensioned to receive said first cross-member, said longitudinally-extending slot being dimensioned to permit said connector to extend therethrough while said cross-member is disposed within said longitudinally-extending bore.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
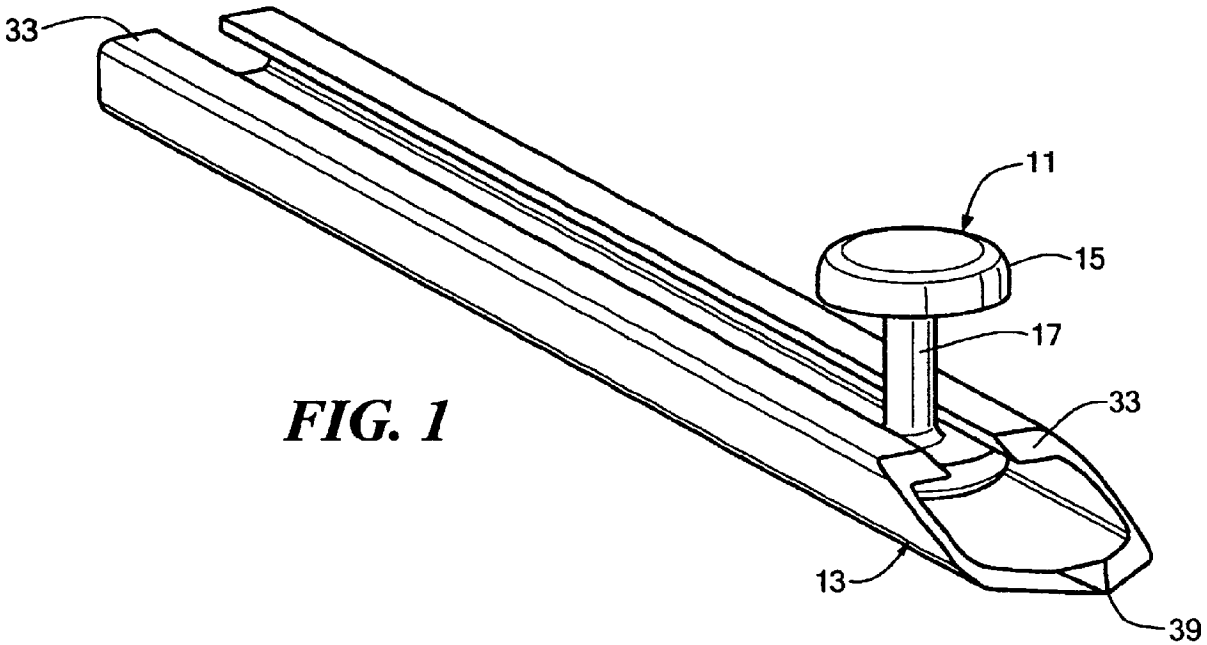
FIG. 1 is a perspective view of an individual plastic fastener and a needle for dispensing the same, the individual plastic fastener and the needle being constructed according to the teachings of the present invention, one cross-member of the individual plastic fastener being disposed within the central bore of the needle.
Figure 2:
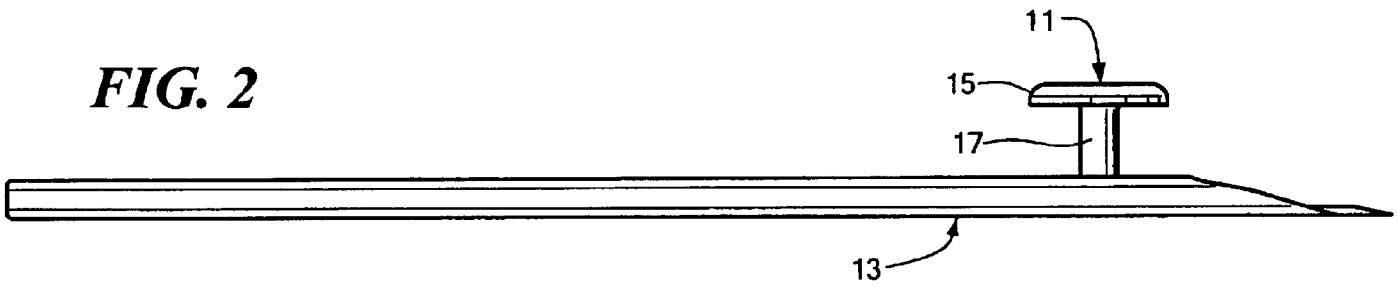
FIG. 2 is a side view of the individual plastic fastener and needle shown in FIG. 1.

Referring now to FIGS. 1 and 2, there is shown an individual plastic fastener and a needle for dispensing the same. The individual plastic fastener is constructed according to the teachings of the present invention and is identified generally by reference numeral 11. The needle is constructed according to the teachings of the present invention and is identified generally by reference numeral 13.

Figure 3:
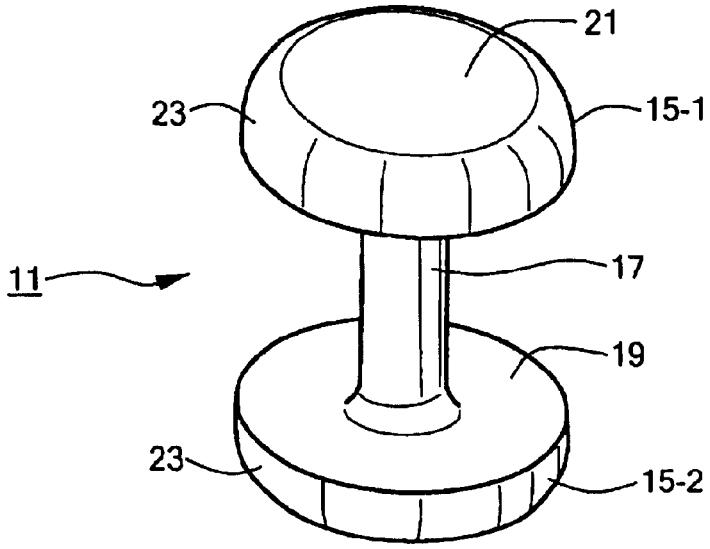
FIG. 3 is a perspective view of the individual plastic fastener shown in FIG. 1.
Figure 4:
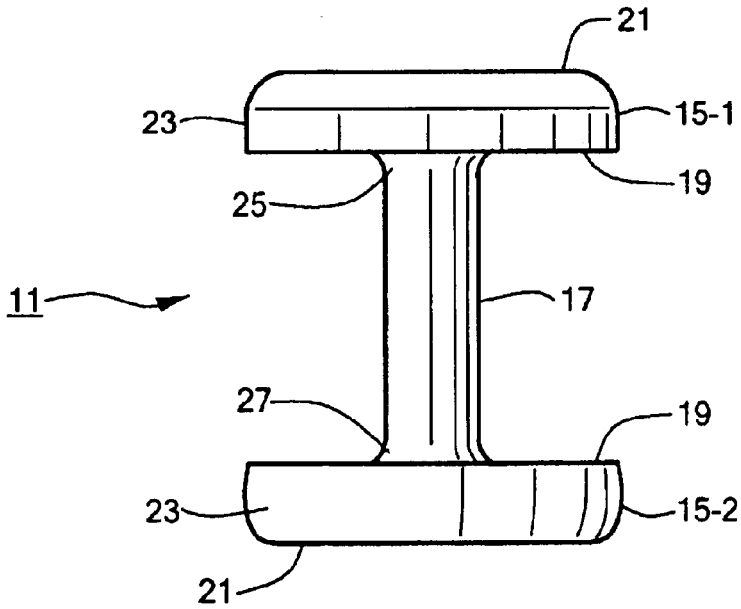
FIG. 4 is a side view of the individual plastic fastener shown in FIG. 1.

Individual plastic fastener 11 is constructed of a plastic material, such as nylon, polyethylene or polypropylene, and comprises a pair of cross-members 15-1 and 15-2 which are coupled together by a connector 17, as seen most clearly in FIGS. 3 and 4. As can be appreciated, individual plastic fastener 11 is designed for use in any application which requires the coupling together of two or more items. As an example, individual plastic fastener 11 can be used to attach a label or price tag to an article of commerce. As another example, individual plastic fastener 11 can be used as a staple to secure together two or more pieces of paper.

Each cross-member 15 of individual plastic fastener 11 is in the shape of a thin disk (or button) which comprises a flat inner surface 19, a flat outer surface 21 and a slightly rounded, or curved, side surface 23.

Each cross-member 15 of individual plastic fastener 11 is shown as being in the form of a thin disk which is generally circular in lateral cross-section. However, it is to be understood that each cross-member 15 of individual plastic fastener 11 is not limited to being in the shape of a thin disk which is generally circular in lateral cross-section. Rather, each cross-member 15 of individual plastic fastener could be in the form of a thin disk which has an alternative geometric shape (i.e., oval, triangular or rectangular) in lateral cross-section without departing from the spirit of the present invention.

Inner surface 19 of each cross-member 15 has a surface area which is slightly greater than the surface area of outer surface 21. As a result, each cross-member 15 is provided with a lateral cross-sectional surface area which gradually decreases from inner surface 19 to outer surface 21.

It should be noted that cross-members 15-1 and 15-2 need not be identical in size and shape. Rather, it is to be understood that one of cross-members 15 could be modified in size and/or shape (i.e., to have a conventional paddle-type shape) without departing from the spirit of the present invention.

Connector 17 couples cross-member 15-1 to cross-member 15-2. Specifically, connector 17 is in the form of a thin, straight, cylindrical filament which includes a first end 25 and a second end 27. First end 25 of connector 17 is integrally formed onto the approximate center of inner surface 19 of cross-member 15-1. Similarly, second end 27 of connector 17 is integrally formed onto the approximate center of inner surface of cross-member 15-2, thereby rendering individual plastic fastener 11 a unitary device.

Connector 17 of fastener 11 preferably has a relatively short length (i.e., in the range between approximately 1 inch and approximately 2 inches) when compared to the length of filaments of conventional plastic fasteners. As can be appreciated, the relatively short length of connector 17 renders fastener 11 ideal for paper stapling applications, which is highly desirable.

It should be noted that the particular size and shape of connector 17 could be modified without departing from the spirit of the present invention. For example, connector 17 could be generally D-shaped in lateral cross-section without departing from the spirit of the present invention.

It should also be noted that connector 17 is not limited to being constructed of plastic. Rather, it is to be understood that connector 17 could be constructed of a non-plastic material (i.e., multiple strands of thread) without departing from the spirit of the present invention.

Although shown as an individual plastic fastener 11, it is to be understood that a continuous supply of individual plastic fasteners 11 could be manufactured using conventional molding techniques without departing from the spirit of the present invention. For example, a continuous supply of individual plastic fasteners 11 could be manufactured through a process of continuous molding by connecting each individual plastic fastener 11 to a common runner bar and/or by connecting successive individual plastic fasteners 11 with one or more thin, severable connectors.

Figure 5:
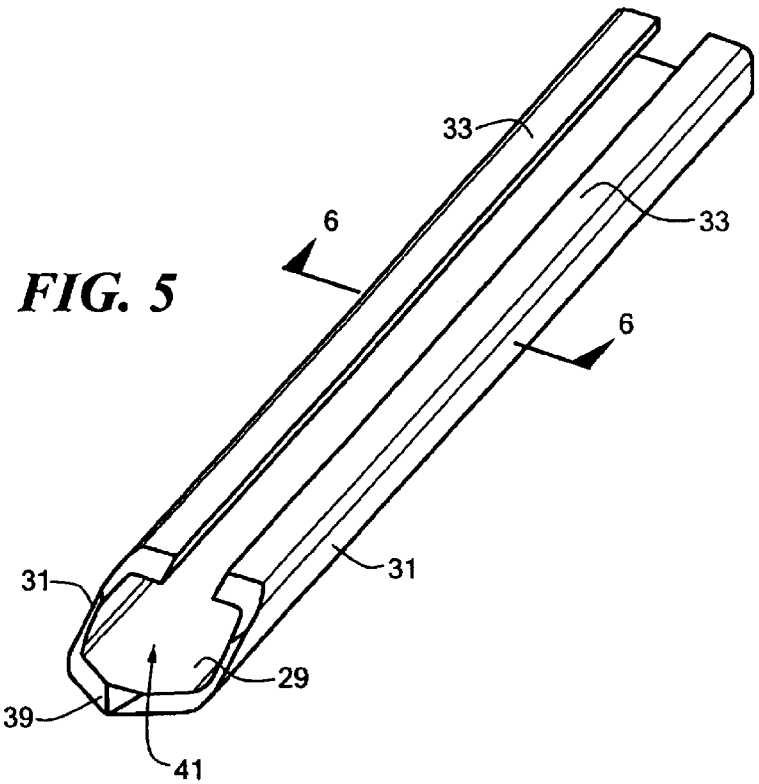
FIG. 5 is a perspective view of the needle shown in FIG. 1.
Figure 6:
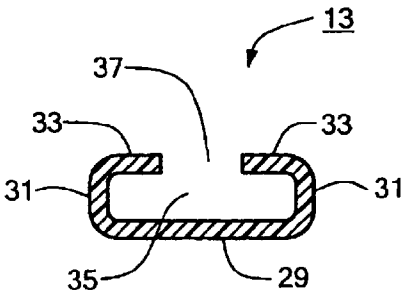
FIG. 6 is a section view of the needle shown in FIG. 5, taken along lines 6—6.
Figure 7:
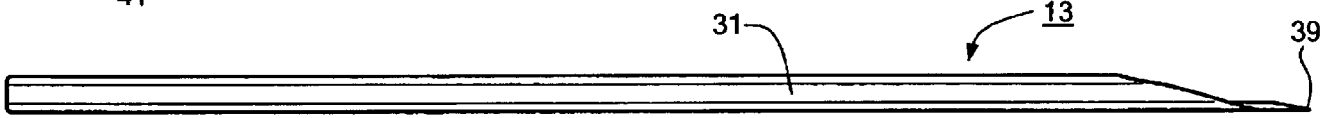
FIG. 7 is a side view of the needle shown in FIG. 5.

Referring now to FIGS. 5–7, needle 13 is preferably constructed from a single sheet of metal which is stamped, or machined, to shape using conventional needle manufacturing techniques.

Needle 13 comprises a flat bottom wall 29 which is slightly wider than the width of inner surface 19 of each cross-member 15 of individual fastener 11. A pair of spaced apart, substantially flat sidewalls 31 extend orthogonally up from flat bottom wall 29. A pair of substantially flat flanges 33 are formed onto and extend orthogonally inward from sidewalls 31, one flange 33 being formed onto the free end of each sidewall 31, as seen most clearly in FIGS. 5 and 6.

Bottom wall 29, sidewalls 31 and flanges 33 together define a central bore 35 which extends longitudinally across substantially the entire length of needle 13. It should be noted that the lateral cross-sectional area of central bore 35 closely corresponds to the longitudinal cross-sectional area of each cross-member 15 of fastener 11, as seen most clearly in FIG. 1. Specifically, central bore 35 is generally rectangular in lateral cross-section, as seen most clearly in FIG. 6. It should be noted that the lateral cross-sectional area of central bore 35 is slightly larger than the longitudinal cross-sectional area of each cross-member 15 of fastener 11 in order to allow cross-member 15 to be received within and travel freely through central bore 35.

Flanges 33 inwardly protrude towards one another, the free ends of flanges 33 being spaced slightly apart so as to define an elongated, narrow slot 37 therebetween, slot 37 extending longitudinally across substantially the entire length of needle 13. It should be noted that slot 37 has a width which is slightly larger than the diameter of connector 17. Accordingly, slot 37 is appropriately dimensioned to permit connector 17 to extend therethrough while cross-member 15 is disposed within bore 35.

Needle 13 further comprises a sharpened tip 39 which is adapted to easily pierce through one or more articles of commerce. Due to its unique configuration, sharpened tip 39 creates a thin slit in the one or more articles of commerce when inserted therethrough. To the contrary, conventional cylindrically-shaped needles typically create a circular hole in the items into which they are inserted. As can be appreciated, the creation of a thin slit, rather than a circular hole, is advantageous in particular applications (i.e., paper stapling applications).

A portion of elongated slot 37 proximate to sharpened tip 39 is shaped to define an enlarged opening 41 which is greater in size than each cross-member 15 of plastic fastener 11. As such, a cross-member 15 traveling forward through bore 35 is capable of exiting needle 13 through enlarged opening 41.

It should be noted that needle 13 is designed for use in any conventional plastic fastener dispensing device (i.e., any standard tagger gun). For example, needle 13 may be used in the apparatus for dispensing plastic fasteners which is disclosed in U.S. Pat. No. 4,288,017 to D. B. Russell, which is incorporated herein by reference.

Installed into a standard fastener dispensing device, needle 13 may be used to dispense individual plastic fastener 11 through two or more items (i.e., two or more pieces of paper) in the following manner. Plastic fastener 11 is first loaded into the fastener dispensing device in position behind needle 13 (i.e., by inserting fastener 11 into a slot formed in the housing of the device). With plastic fastener 11 loaded into the fastener dispensing device, the user manually inserts sharpened tip 39 of needle 13 through the items to be coupled (tip 39 creating a thin slit in the items to be coupled). Having inserted tip 39 of needle 13 through the items to be coupled, the user activates a trigger mechanism on the fastener dispensing device which, in turn, causes a plunger to protrude axially forward through bore 35 of needle 13. As the plunger is displaced forward, the plunger contacts and urges a cross-member 15 of fastener 11 through bore 35. As cross-member 15 of fastener 11 is displaced forward through bore 35, connector 17 similarly travels through slot 37. At the completion of the forward stroke of the tagger gun, the ejector rod urges cross-member 15 out through enlarged opening 41 of needle 13, thereby dispensing plastic fastener 11 in such a manner so that first and second cross-members 15-1 and 15-2 are disposed on opposite sides of the items to be coupled.

As can be appreciated, the particular design of individual plastic fastener 11 provides fastener 11 with numerous benefits over conventional plastic fasteners. As an example, when inserted through one or more articles of commerce, the particular size and shape of cross-members 15 of plastic fastener 11 does not aesthetically detract from the articles of commerce, which is a principal feature of the present invention. As another example, due to the shortened length of connector 17 and the particular shape of cross-members 15, plastic fastener 11 has considerable usefulness in paper stapling applications, which is a principal feature of the present invention.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A fastener for coupling together two or more items, said fastener comprising:

(a) a connector having a first end and a second end, (b) a first cross-member formed onto the first end of said connector, said first cross-member being in the form of a thin disk comprising a flat inner surface and a flat outer surface, the first end of said connector being formed onto the flat inner surface of said first cross-member, and (c) a second cross-member formed onto the second end of said connector.

2. The fastener as claimed in claim 1 wherein said first cross-member is in the form of a thin disk which is generally circular in lateral cross-section.

3. The fastener as claimed in claim 1 wherein the inner surface of said first cross-member has a surface area which is slightly greater than the surface area of the outer surface of said first cross-member.

4. The fastener as claimed in claim 1 wherein said first cross-member comprises a side surface which extends between the inner surface of said first cross-member and the outer surface of said first cross-member.

5. The fastener as claimed in claim 4 wherein the side surface of said first cross-member is rounded.

6. The fastener as claimed in claim 1 wherein said connector is in the form of a thin, straight filament.

7. The fastener as claimed in claim 1 wherein the first end of said connector is formed onto the approximate center of the inner surface of said first cross-member.

8. The fastener as claimed in claim 1 wherein said second cross-member comprises a flat inner surface and a flat outer surface.

9. The fastener as claimed in claim 8 wherein said second cross-member is in the form of a thin disk.

10. The fastener as claimed in claim 1 wherein said fastener is constructed of plastic.

11. A combination of a fastener and a needle, said fastener comprising a connector having a first cross-member at a first end thereof and a second cross-member at a second end thereof, each of the first and second cross-members being in the form of a thin disk which includes an inner surface and an outer surface, the first end of said connector being formed onto the inner surface of the first cross-member and the second end of said connector being formed onto the inner surface of the second cross-member, said needle terminating in a tip at a front end thereof and being shaped to define a longitudinally-extending bore and a longitudinally-extending slot, said longitudinally-extending bore being dimensioned to receive one of said first and second cross-members, said longitudinally-extending slot being dimensioned to permit said connector to extend therethrough while said one of said first and second cross-members is disposed within said longitudinally-extending bore.

12. The combination as claimed in claim 11 wherein said needle comprises:

(a) a flat bottom wall, (b) a pair of flat, spaced apart sidewalls which extend orthogonally up from said flat bottom wall, and (c) a pair of flat flanges, one flange being formed onto and extending orthogonally inward from the free end of each of said pair of sidewalls.

13. The needle as claimed in claim 12 wherein the bore defined by said needle is generally rectangular in lateral cross-section.

14. A fastener for coupling together two or more items, said fastener comprising:

(a) a connector having a first end and a second end, (b) a first cross-member formed onto the first end of said connector, said first cross-member being in the form of a thin disk, and (c) a second cross-member formed onto the second end of said connector, said second cross-member being in the form of a thin disk.

* * * * *